United States Patent [19]

Schnegg

[11] Patent Number: 4,845,960

[45] Date of Patent: Jul. 11, 1989

[54] WEFT INSERTION FABRIC WITH TERRY EFFECT

[75] Inventor: Julius R. Schnegg, Burlington, N.C.

[73] Assignee: Burlington Industries, Inc., Greensboro, N.C.

[21] Appl. No.: 546,957

[22] Filed: Oct. 31, 1983

[51] Int. Cl.[4] ..... D04B 23/06

[52] U.S. Cl. ..... 66/84 A; 66/85 A; 66/196; 66/194

[58] Field of Search ..... 66/190, 191, 194, 196, 66/84 A, 85 A

[56] References Cited

U.S. PATENT DOCUMENTS

| | | | |
|---|---|---|---|
| 2,696,723 | 12/1954 | Frith | 66/192 |
| 2,932,181 | 4/1960 | MacCaffray | 66/210 |
| 3,213,646 | 10/1965 | Van Patten | 66/191 |
| 3,367,333 | 2/1968 | Scheier | 66/85 A |
| 3,442,101 | 5/1969 | Ploch et al. | 66/194 |
| 3,603,117 | 9/1971 | Svoboda et al. | 66/194 |
| 3,722,442 | 3/1973 | MacIsaac et al. | 66/85 A |
| 3,732,708 | 5/1973 | Troy | 66/191 |
| 3,769,815 | 11/1973 | Ploch et al. | 66/191 |
| 3,797,278 | 3/1974 | Kohl | 66/84 A |
| 3,916,649 | 11/1975 | Kohl | 66/84 A |
| 4,026,129 | 5/1977 | Sternlieb | 66/192 |
| 4,249,981 | 2/1981 | Pelletier et al. | 66/84 A X |

FOREIGN PATENT DOCUMENTS 2420612 10/1975 Fed. Rep. of Germany ..... 66/84 A

OTHER PUBLICATIONS

Bahlo, K. W., "New Fabrics Without Weaving", Modern Textile Magazine, Nov. 1965, pp. 51 to 54.

Bahlo, K. W., "Mali Techniques", Knitted Outerwear Times, Nov. 1968, pp. 61 to 63.

*Primary Examiner*—Ronald Feldbaum

*Attorney, Agent, or Firm*—Nixon & Vanderhye

[57] ABSTRACT

A weft insertion warp knit fabric having a terry or boucle effect is produced by overfeeding at least some of the wrap yarns to a conventional weft inserted warp knitting machine, such as a Raschel, (e.g.) Liba, or Mayer. Terry loops extend outwardly from the technical back side of the fabric, and the loops may be continuous over the entire fabric face, or discontinuous, i.e. being disposed in an intermittent pattern. A substrate may be provided to which the warp and weft yarns are stitch bonded, or the fabric may be substrate-free. By varying the knitting yarn denier and/or stitch length, the erectness of the terry loops may also be varied. The fabric is especially suitable for draperies and upholstery.

23 Claims, 4 Drawing Sheets

Fig. 1
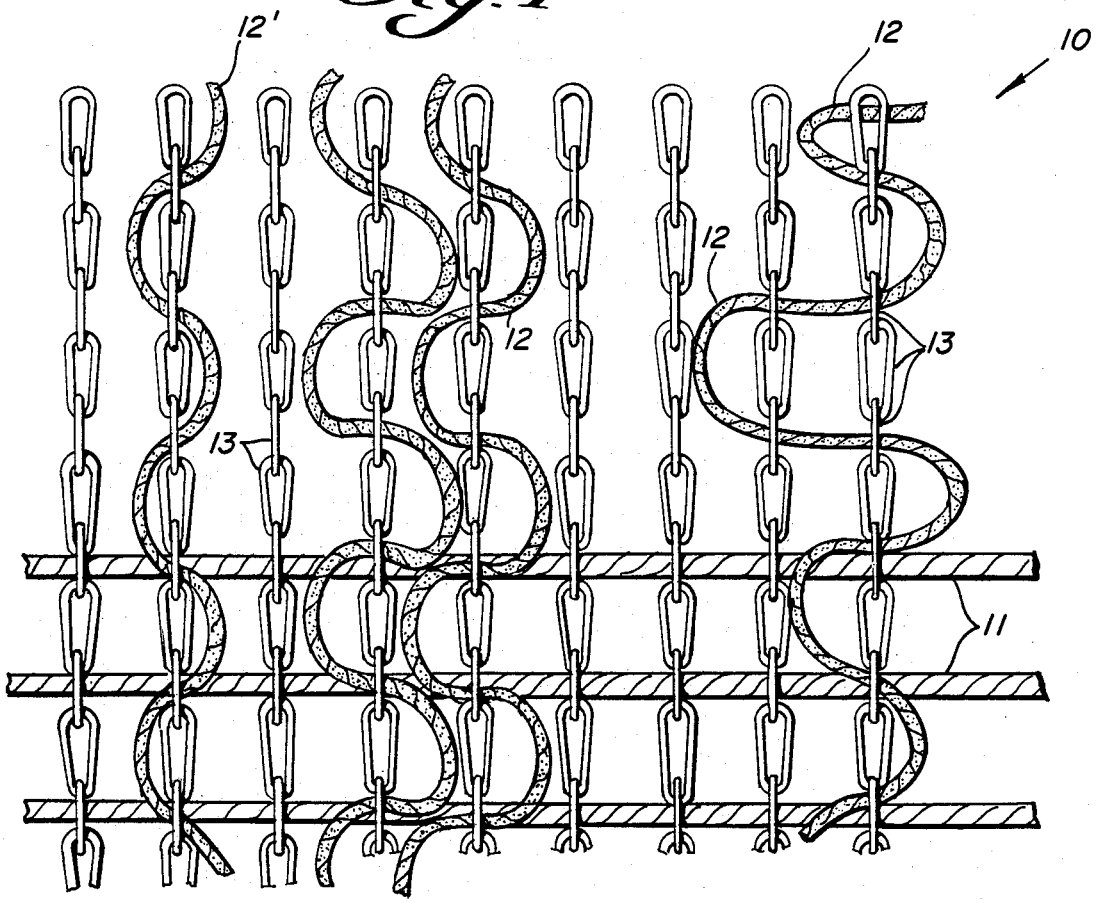
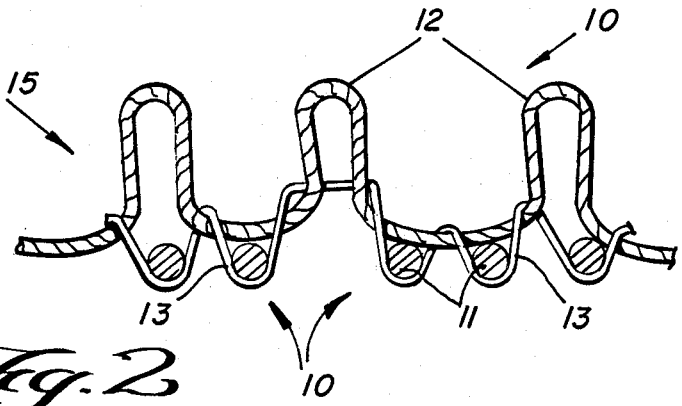
Fig. 2
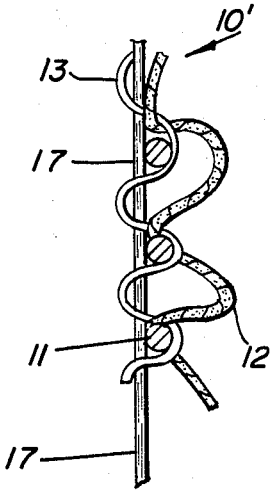
Fig. 3

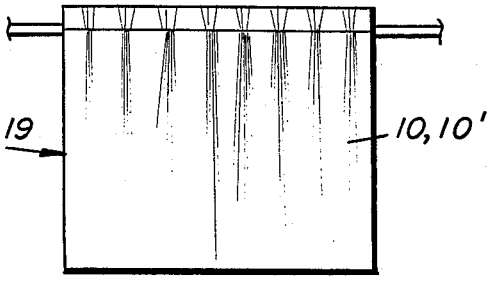
Fig. 4a
Fig. 4b
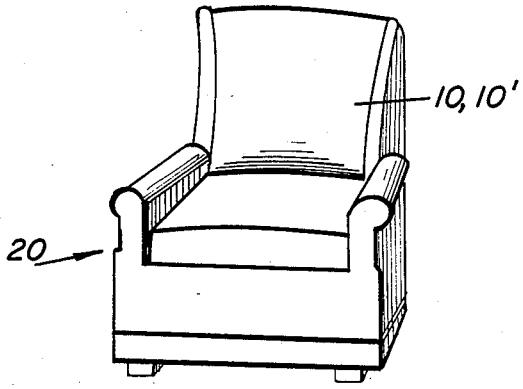
Fig. 5
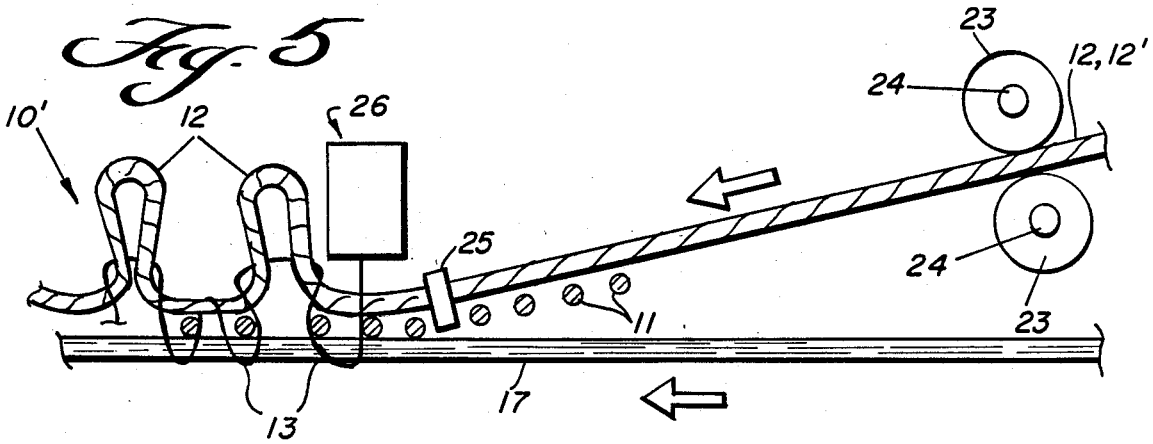

WEFT INSERTION FABRIC WITH TERRY EFFECT

BACKGROUND AND SUMMARY OF THE INVENTION

For many different uses, fabrics having a terry of boucle type effect are desirable. Such fabrics provide for desirable styling and texture effects, and in some environments the terry loops can also be functional.

According to the present invention, a fabric having all of the desirable attributes—from a functional and cost standpoint—of weft inserted warp knit fabrics is provided, which fabric also has the desirable attributes of a terry or boucle type effect. The fabric according to the present invention has a wide variety of uses, but is particularly useful for draperies and upholstery.

According to one aspect of the present invention, a weft inserted warp knit fabric is provided that is characterized in that at least some of the warp yarns form terry loops extending outwardly from one face (the technical back side) of the fabric. The fabric include a substrate to which the warp and weft yarns are stitch bonded, or it may be substrate-free. The terry loops may be provided so that they extend outwardly from substantially the entire face of the fabric, or may be disposed in an intermittent pattern so that they extend outwardly from only a part of the face of the fabric. A wide variety of styling features may be provided by the pattern of disposition, color, denier, and yarn count or density of the yarns forming the terry loops.

The invention also related to a method of making a weft inserted warp knit fabric on a weft-insertion warp knitting machine having warp feed rollers. The fabric according to the invention is produced by overfeeding at least some of the warp yarns to the machine so that they form terry loops extending outwardly from a face of the fabric produced. A typical overfeeding ratio is in a range of about 2.5:1 to 5:1. The warp knitting machine may include feed rollers having electromagnetic clutches, and the terry loops may be disposed intermittently by selectively activating and deactivating the electro-magnetic clutches. The erectness of the terry loops—i.e. the degree of which they extend outwardly from the fabric face—may be varied by varying the knitting yarn denier and/or the stitch length.

According to the present invention upholstery and draperies may be constructed from weft inserted warp knit fabric having terry loops, the draperies and upholstery so produced having the functional and cost advantages of weft inserted warp knit fabrics, and also having the desired styling effects of conventional terry or boucle effect fabrics.

It is the primary object of the present invention to provide a weft inserted warp knit fabric having terry loops, as well as a method of construction, and products of construction. This and other objects of the invention will become clear from an inspection of the detailed description of the invention, and from the appended claims.

BRIEF DESCRIPTION OF THE DRAWINGS

FIG. 1 is a schematic plan view of an exemplary fabric according to the present invention showing the inter-relationship between the warp, weft, and knitting yarns thereof;

FIG. 2 is a schematic side view of the fabric of FIG. 1, showing the weft yarns in cross-section;

FIG. 3 is a side schematic view of another exemplary fabric according to the present invention, this fabric being like that of FIG. 2 only including a substrate;

FIGS. 4*a* and 4*b* are schematic perspective views of products that may be produced utilizing the fabric according to the present invention;

FIG. 5 is a schematic side view of components of an exemplary weft-insertion warp knitting machine that may be utilized in the practice of the method of the present invention; and

DETAILED DESCRIPTION OF THE DRAWINGS

An exemplary weft-inserted warp knit fabric according to the present invention is shown generally by reference numeral 10 in the drawings. Such a fabric, with a backing, is shown by reference numeral 10' in FIGS. 3 and 5. The main components of the fabric are a plurality of weft yarns 11, at least some warp yarns in the form of terry loops 12, and stitching yarn 13 which holds the warp and weft yarn 11, 12 together.

The weft yarns 11 may have a wide variety of denier and material. Typical yarns that are useful in the practice of the invention in conventional weft-insertion Raschel machines include 4/1 Acrylan/Acrylan/-Rayon, and 8/1 Rayon/Acrylan. The warp yarns forming the terry loops 12 also may be selected from a wide variety of yarn types, and denier. Typically, they would be the same as the weft yarns 11 in denier and type, although this is not necessarily so.

Not all the warp yarns need to be formed as terry loops 12. In FIG. 1 the warp yarns 12' are shown laid in straight (i.e. under normal tension), and do not provide terry loops 12.

The knitting yarn 13 may be of any conventional type, and any conventional stitching pattern (e.g. trico loops, chain loops, etc.) may be provided. Depending upon the denier and/or stitch length of the stitching yarn 13, the degree to which the terry loops 12 extend outwardly from the fabric 10 may be varied. As illustrated in the drawings, the terry loops 12 extend outwardly primarily from one face 15 of the fabric—that face being the technical back side.

The fabric 10 illustrated in FIGS. 1 and 2 is substrate-free, consisting of the warp and weft yarns, and the knitting yarn, 11, 12, 12', and 13. However FIG. 3 shows a fabric 10' substantially the same as the fabric illustrated in FIG. 2 only also including a substrate, or backing, 17. The backing 17 is preferably a conventional non-woven fabric, although other backings may be utilized depending upon the particular end use.

In FIG. 1, the terry loops 12 are shown extending outwardly from only a part of the face of the fabric, being disposed in an intermittent pattern. However where desirable, the terry loops may extend outwardly from substantially the entire face of the fabric, being substantially continuous thereover. For a typical 4/1 Acrylan/Acrylan/Rayon warp yarn, 18 courses per inch is a suitable fabric density, and this may be provided continuously over the entire fabric face 15.

The fabric 10, 10' may include a wide variety of styling features. For instance, the styling may be characterized in part by the pattern of disposition of the terry loops 12 over the fabric vis-a-vis straight laid-in warp yarns 12'. Also styling may be provided by color, denier, and yarn count or yarn density variations of the terry loops 12.

FIG. 4*a* shows a typical product that may be produced utilizing the fabric 10, 10' according to the present invention. FIG. 4*a* schematically illustrates a drapery 19 produced from the fabric 10, 10', the drapery being produced in a conventional manner. FIG. 4*b* shows the fabric 10, 10' constructed into upholstery 20.

A typical fabric 10 according to the present invention, and having variations in styling, and taking the form of a piece of drapery, 19.

The fabric 10, 10' according to the present invention is constructed on a weft-insertion warp knitting machine having warp feed rollers. Typical machines that may be utilized in the practice of the method of the present invention, for producing the fabric 10, 10', comprise Raschel and tricot weft-insertion warp knitting machines, such as Liba, Mayer, as well as stitch bonding machines such as Malimo machines.

FIG. 5 schematically illustrates various components of a conventional Raschel weft-insertion warp knitting machine for practicing the method according to the present invention. Feed rollers 23, each preferably having an electro-magnetic clutch 24 associated therewith, feed the warp yarns 12, 12' through pattern bars 25 to the knitting apparatu2 6, the weft yarns 11 being inserted at the same time. The knitting structure 26 stitches the warp and weft yarns 12, 12', 11, to a conventional non-woven substrate 17, or the like.

In the practice of the method according to the present invention utilizing the apparatus illustrated schematically in FIG. 5, a weft inserted warp knit fabric 10, 10' is produced by overfeeding at least some of the warp yarns (12) to the machine so that they form terry loops extending outwardly from a face of the fabric being produced. The overfeeding is practiced by driving the feed roller 23 at a higher speed than conventional. For instance the rollers 23 may be driven with an overfeed ratio in a range of about 2.5:1 to 5:1 for a good boucle or terry effect. Different speeds can be achieved by selecting different gear ratios for driving the rollers 23.

By selectively actuating the electromagnetic clutches 24, the overfeeding effect can be selectively activated, or deactivated, to provide the terry loops 12 intermittently along the warp-wise direction of the fabric 10, 10'. Different patterns of terry loops can also be produced by varying the knitting construction (e.g. trico loops, chain loops, etc. as well as different laying in movements) and the overfeeding can be practiced to provide terry loops 12 extending outwardly from the entire face 15 of the fabric, or only selectively over portions thereof.

It will thus be seen that according to the present invention a new type of weft-inserted warp knit fabric has been provided, as well as a method of making the fabric, and products—particularly draperies and upholstery—produced therefrom.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A method of making a weft inserted warp knit fabric on a weft-insertion warp knitting machine having warp feed rollers, comprising the steps of: feeding warp yarns; inserting weft yarns; stitching the warp and weft yarns together with stitching yarns which passes between and around the warp and weft yarns; and overfeeding at least some of the warp yarns directly to the machine using the feed rollers so that they form terry loops extending outwardly from a face of the fabric being produced.

2. A method as recited in claim 1 wherein said overfeeding is practiced continuously.

3. A method as recited in claim 1 wherein said overfeeding is practiced intermittently.

4. A method as recited in claim 3 wherein the warp knitting machine includes warp feed rollers having electro-magnetic clutches; and wherein said intermittent overfeeding is practiced by selectively activating and deactivating the electro-magnetic clutches.

5. A method as recited in claim 1 comprising the further step of feeding a substrate to the machine to be stitch bonded to the warp and weft yarns by the stitching yarn.

6. A method as recited in claim 1 wherein the face from which the terry loops extend is the technical back side.

7. A method as recited in claim 1 comprising the further step of varying the erectness of the terry loops—i.e. the degree to which they extend outwardly from the face—by varying the stitching yarn denier and/or the stitched length.

8. A method as recited in claim 1 wherein said overfeeding step is practiced so that the overfeed ratio is in the range of about 2.5:1 to 5:1.

9. A method as recited in claim 1 comprising the further step of producing different patterns of terry loops by varying the stitching construction.

10. A method as recited in claim 1 wherein said overfeeding step is practiced to provide terry loops extending outwardly from substantially the entire face of the fabric, being substantially continuous thereover.

11. A method as recited in claim 1 wherein said overfeeding is practiced so that the terry loops extend outwardly from only a part of the face of the fabric, being disposed in an intermittent pattern thereover.

12. A weft inserted warp knit fabric consisting of:

a plurality of parallel weft yarns;

a plurality of generally parallel warp yarns, the warp yarns being generally perpendicular to the weft yarns;

stitching yarn holding the warp and weft yarns together, said stitching yarns passing between and around the warp and weft yarns; and characterized in that at least some of the warp yarns form terry loops extending outwardly from one face of the fabric.

13. A fabric as recited in claim 12 wherein said terry loops extend outwardly from substantially the entire face of the fabric, being continuous thereover.

14. A fabric as recited in claim 12 wherein said terry loops extend outwardly from only a part of a face of the fabric, being disposed in an intermittent pattern.

15. A fabric as recited in claim 12 wherein said one face from which the terry loops extend comprises the technical back side of the fabric.

16. A weft inserted warp knit fabric consisting of:

a plurality of parallel weft yarns;

a plurality of generally parallel warp yarns, the warp yarns being generally perpendicular to the weft yarns;

a substrate; and stitching yarn stitch bonding the warp and weft yarns to the substrate, and passing between and around the warp and weft yarns to stitch them to the substrate; characterized in that at least some of the warp yarns form terry loops extending outwardly from one face of the fabric.

17. A fabric as recited in claim 16 wherein said terry loops extend outwardly from substantially the entire face of the fabric, being continuous thereover.

18. A fabric as recited in claim 16 wherein said terry loops extend outwardly from only a part of a face of the fabric, being disposed in an intermittent pattern.

19. A fabric as recited in claim 16 wherein said one face from which the terry loops extend comprises the technical back side of fabric.

20. A weft inserted warp knit drapery fabric made on a weft insertion warp knitting machine having warp feed rollers, by practicing the steps of: feeding warp yarn; inserting weft yarns; stitching the warp and weft yarns together with stitching yarn which passes between and around the warp and the weft yarns; and overfeeding at least some of the warp yarns directly to the machine using the feed rollers so that they form terry loops extending outwardly from a face of the fabric produced.

21. A drapery fabric as recited in claim 20 including a substrate to which the warp and weft yarns are stitch bonded by the stitching yarn.

22. A drapery fabric as recited in claim 20 wherein the terry loops extend outwardly from substantially the entire face of the fabric, being substantially continuous thereover.

23. A drapery fabric as recited in claim 20 wherein the terry loops extend outwardly from only a part of the face of the fabric, being disposed in an intermittent pattern thereover.

* * * * *